US005552818A

United States Patent [19]

Agano et al.

[11] Patent Number: 5,552,818

[45] Date of Patent: Sep. 3, 1996

[54] METHOD AND APPARATUS FOR CONTROLLING THE MOISTURE CONTENT OF A THERMOSENSITIVE RECORDING MEDIUM IN A THERMAL RECORDING APPARATUS

[75] Inventors: Toshitaka Agano; Yasuhiko Goto, both of Kanagawa-ken, Japan

[73] Assignee: Fuji Photo Film Co., Ltd., Kanagawa, Japan

[21] Appl. No.: 134,905

[22] Filed: Oct. 13, 1993

[30] Foreign Application Priority Data

Oct. 14, 1992 [JP] Japan ..... 4-276236
Oct. 14, 1992 [JP] Japan ..... 4-276237

[51] Int. Cl.[6] ..... H01N 1/21

[52] U.S. Cl. ..... 347/133; 347/187

[58] Field of Search ..... 347/133, 224, 347/262, 264, 187

[56] References Cited

U.S. PATENT DOCUMENTS 4,469,026 9/1984 Irwin ..... 347/102
5,428,379 6/1995 Kaneko et al. ..... 347/23

FOREIGN PATENT DOCUMENTS 50-23617 3/1975 Japan .
58-94494 6/1983 Japan .
61-291183 12/1986 Japan .
62-77983 4/1987 Japan .
62-78964 4/1987 Japan .
5-24219 2/1993 Japan .
5-220990 8/1993 Japan .
5-301447 11/1993 Japan .

*Primary Examiner*—Mark J. Reinhart
*Attorney, Agent, or Firm*—Sughrue, Mion, Zinn, Macpeak & Seas

[57] ABSTRACT

A method of and an apparatus for thermally recording an image on a thermo-sensitive recording medium. The apparatus comprises a heating mechanism for applying the thermo-sensitive recording medium with a coloring thermal energy to record the image, a conveying mechanism for moving the recording medium in a sub-scanning direction, a moisture content adjusting mechanism for adjusting the moisture content of the recording medium unexposed to the thermal energy, a humidity detecting mechanism for detecting the humidity in the vicinity of the position where the recording medium is exposed to the thermal energy, and a controller for controlling the moisture content adjusting mechanism based on the detected humidity.

27 Claims, 7 Drawing Sheets

METHOD AND APPARATUS FOR CONTROLLING THE MOISTURE CONTENT OF A THERMOSENSITIVE RECORDING MEDIUM IN A THERMAL RECORDING APPARATUS

BACKGROUND OF THE INVENTION

1. Field of the Invention

This invention relates to a method of and an apparatus for thermally recording an image or a thermo-sensitive recording medium by applying a coloring thermal energy of the thermo-sensitive recording medium.

2. Description of the Related Art

A thermal recording apparatus for thermally recording an image or the like on a thermo-sensitive recording medium is now widely in use. In particular, a thermal recording apparatus with a laser as a heat source, which can record an image at high speed, has been proposed (see Japanese Laid-Open Patent Publication Nos. 50-23617, 58-94494, 62-77983 and 62-78964, for example).

The present applicant has proposed a thermo-sensitive recording medium which is applicable to such a thermal recording apparatus and capable of recording a satisfactory image thereon, which includes leuco dyes, a developer and light-absorbing dyes extended on a support and develops color whose density varies in response to the thermal energy applied thereto (see Japanese Patent Application No. 3-62684 and Japanese Laid-Open Patent Publication No. 5-24219).

The thermo-sensitive recording medium, proposed by the applicant, has a thermo-sensitive layer formed on the support by coating it with an emulsion containing at least the developer, the light-absorbing dyes and a heat-fusible microcapsule containing at least leuco dyes, all dissolved and emulsified in an organic solvent which is insoluble or hardly soluble in water.

When an image or the like is recorded on such a thermo-sensitive recording medium, the humidity in the atmosphere in the thermal recording apparatus is not necessarily kept constant. When the humidity becomes high, the amount of moisture or water contained in the thermo-sensitive recording medium increases, and the sensitivity of the thermo-sensitive recording medium is enhanced. A problem has thus been pointed out in the conventional thermal recording apparatus that the sensitivity of the thermo-sensitive recording medium varies depending on the humidity, which makes it difficult to precisely record an image having a desired gradation.

SUMMARY OF THE INVENTION

The present invention has been made to solve such a problem. It is therefore an object of the present invention to provide a method of and an apparatus which enable to maintain the sensitivity of a thermo-sensitive recording medium constant, without being affected by a variation in the humidity, and to make it possible, at all times, to thermally record an image or the like with precision on the thermo-sensitive recording medium.

According to an aspect of this invention, for achieving the above object, there is provided a method of thermally recording an image or the like on a thermo-sensitive recording medium by applying a coloring thermal energy of the thermo-sensitive recording medium, comprising the steps of adjusting the amount of moisture contained in the thermo-sensitive recording medium, and applying the coloring thermal energy for thermally recording the image or the like on the thermo-sensitive recording medium whose moisture content has been adjusted.

According to another aspect of this invention, there is also provided an apparatus for thermally recording an image or the like on a thermo-sensitive recording medium by applying a coloring thermal energy of the thermo-sensitive recording medium, comprising a heating mechanism for applying the coloring thermal energy for thermally recording the image or the like on the thermo-sensitive recording medium in a line, a conveying mechanism for conveying the thermo-sensitive recording medium in a direction perpendicular to the line, and a moisture content adjusting mechanism for adjusting the amount of moisture contained in the thermo-sensitive recording medium prior to the application of the coloring thermal energy.

A preheating means for applying the thermo-sensitive recording medium a thermal energy less than the coloring thermal energy may be attached to the thermal recording apparatus so as to serve as the moisture content adjusting mechanism.

In the thermal recording method and apparatus according to the present invention, the amount of moisture or water contained in the thermo-sensitive recording medium is adjusted prior to application of the coloring thermal energy to the thermo-sensitive recording medium so that the image or the like can be recorded at a constant sensitivity of the thermo-sensitive recording medium.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Thermal recording methods and thermal recording apparatuses according to the present invention will hereinafter be described in detail with reference to the accompanying drawings in which preferred embodiments are shown by way of illustrative example.

Figure 1:
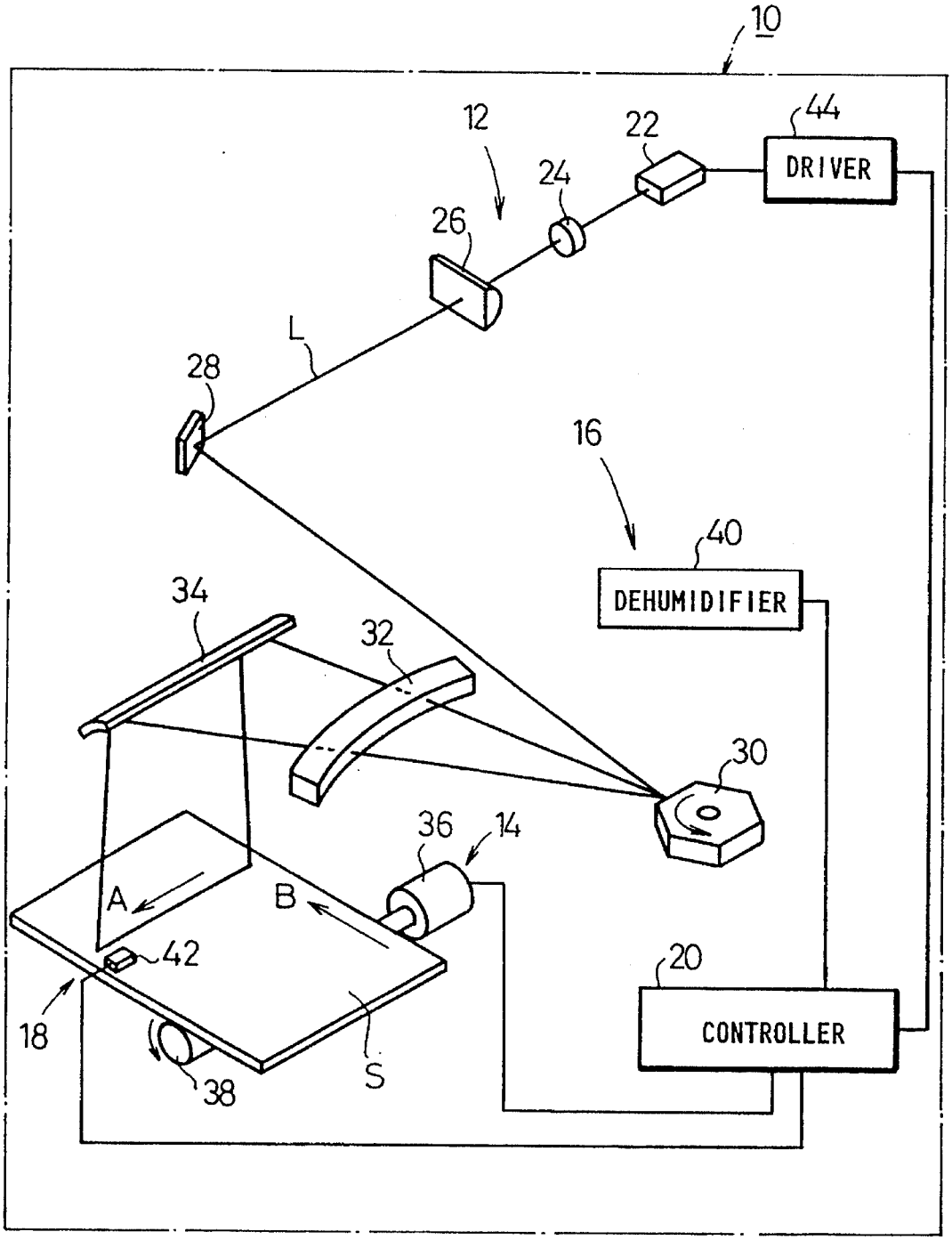
FIG. 1 is a perspective view showing the structure of a thermal recording apparatus according to a first embodiment of the present invention.

In FIG. 1, reference numeral 10 indicates a thermal recording apparatus according to a first embodiment. The thermal recording apparatus 10 comprises a laser beam irradiating mechanism 12 for irradiating a thermo-sensitive recording medium S with a laser beam L in a main scanning direction (i.e., in the direction indicated by the arrow A) so as to supply or apply a coloring thermal energy to the thermo-sensitive recording medium S to thereby record an image or the like thereon, a sub-scanning conveying mechanism 14 for conveying the thermo-sensitive material S in a sub-scanning direction (i.e., in the direction indicated by the arrow B) perpendicular to the main scanning direction, a moisture content adjusting mechanism 16 for adjusting the amount of moisture contained in the thermo-sensitive recording medium S which is not yet irradiated with the laser beam L, a humidity detecting mechanism 18 for detecting humidity in the vicinity of the a spot where the thermo-sensitive recording medium is irradiated with the laser beam L, and a controller 20 for controlling the moisture content adjusting mechanism 16 based on a value detected by the humidity detecting mechanism 18.

Figure 11:
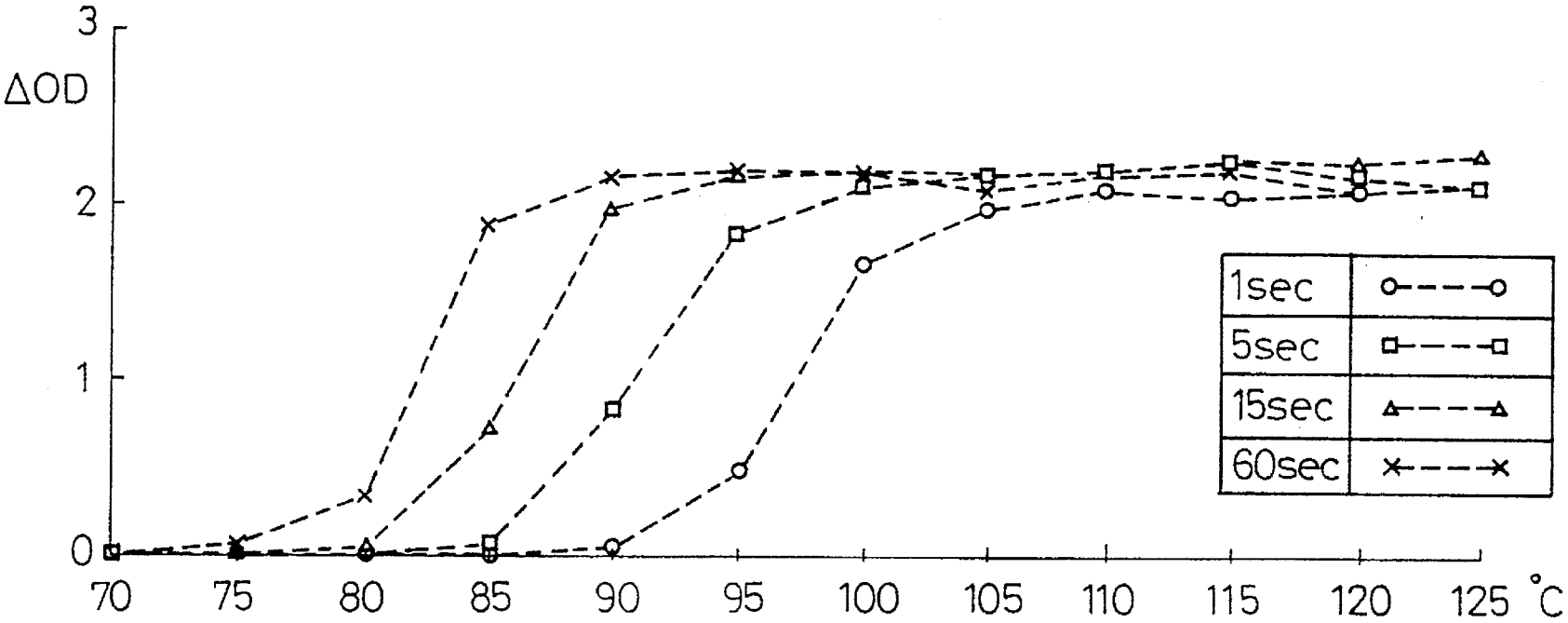
FIG. 11 is a characteristic diagram showing the relationship of the color density of the thermo-sensitive recording medium with respect to the heating temperature and heating time.

The color of the thermo-sensitive recording medium S is developed in accordance with the applied thermal energy. The density of color is determined as a function of a preheating temperature and a preheating time period. The relationships of the color density with respect to the temperature and time period are shown in FIG. 11. As illustrated, there are two ways of developing color of the thermo-sensitive recording medium S, by elevating the temperature at a given time period, or by elongating the time period at a given temperature.

The laser beam irradiating mechanism 12 comprises a laser diode 22 for producing a laser beam L therefrom, a collimator lens 24 for making the laser beam L parallel as a bundle of light rays, a cylindrical lens 26, a reflection mirror 28, a polygon mirror 30 for deflecting the laser beam L, an fθ lens 32 and a cylindrical mirror 34 for correcting a plane inclination of the polygon mirror 30 in cooperation with the cylindrical lens 26.

The sub-scanning conveying mechanism 14 has a motor 36 and a feed roller 38 coupled to the motor 36, for conveying the thermo-sensitive recording medium S in the direction indicated by the arrow B for sub-scanning.

The moisture content adjusting mechanism 16 has a dehumidifier 40 disposed within the thermal recording apparatus 10.

The dehumidifier 40 is used to remove the humidity from the thermal recording apparatus 10 so as to reduce the moisture contained in the thermo-sensitive recording medium S as low as possible. A temperature regulator provided with dehumidifying and humidifying functions may also be used as an alternative to the dehumidifier 40. The temperature regulator keeps the humidity in the thermal recording apparatus 10 constant to adjust the moisture contained in the thermo-sensitive recording medium S to a given quantity at all times.

The humidity detecting mechanism 18 provides a humidity sensor 42 placed in the close vicinity above the irradiated spot of the thermo-sensitive recording medium S. The controller 20 electrically connected to the humidity sensor 42 drives and controls the polygon mirror 30, the motor 36 and the dehumidifier 40. Further, the controller 20 is electrically connected to a driver 44 for driving the laser diode 22.

The operation of the thermal recording apparatus 10 constructed as described above will now be described in connection with the thermal recording method according to the present embodiment.

The humidity sensor 42 first detects the humidity in the atmosphere existing in the vicinity of the spot where the thermo-sensitive recording medium S is irradiated with the laser beam L and supplies the detected humidity to the controller 20. The controller 20 then drives the dehumidifier 40 of the moisture content adjusting mechanism 16 based on the detected humidity so as to maintain the humidity in the thermal recording apparatus 10 below a predetermined value.

The motor 36 in the sub-scanning conveying mechanism 14 is driven by the controller 20, and the feed roller 38 coupled to the motor 36 is rotated in the direction indicated by the arrow to feed the thermo-sensitive recording medium S in the direction indicated by the arrow B.

The laser diode 22 is driven by the driver 44 so as to produce a laser beam L modulated according to a gradation signal of the image to be recorded on the thermo-sensitive recording medium S. The laser beam L is made parallel as a bundle of light by the collimator lens 24 and thereafter introduced into the polygon mirror 30 through the cylindrical lens 26 and the reflection mirror 28.

The polygon mirror 30 is being rotated at a high speed in the direction indicated by the arrow under the drive action of the controller 20. The laser beam L reflected from a reflection surface of the polygon mirror 30 is introduced into the thermo-sensitive recording medium S via the fθ lens 32 and the cylindrical mirror 34.

The thermo-sensitive recording medium S, which is being fed for sub-scanning in the direction indicated by the arrow B, is main-scanned with the laser beam L in the direction indicated by the arrow A. As a result, the coloring thermal energy is applied to the thermo-sensitive recording medium S to record the image or the like thereon.

In the first embodiment, the humidity contained in the thermal recording apparatus 10 is adjusted by the dehumidifier 40 of the moisture content adjusting mechanism 16, so that the amount of the moisture contained in the thermo-sensitive recording medium S may be reduced to an appreciable extent. Thus, variation in the sensitivity of the thermo-sensitive recording medium S due to a change in the humidity in the thermal recording medium 10 can be prevented. As a result, a desired gradational image or the like can be recorded with high accuracy on the thermo-sensitive recording medium S.

Incidentally, if the thermo-sensitive surface of the recording medium S is covered with a glass plate, a polyethylene terephthalate (PET) plate, or the like while recording, it may be possible to avoid the moisture contained in the region adjacent to the main scan-line of the thermo-sensitive recording medium S from varying due to the heat generated by the laser beam L irradiated thereto.

The dehumidifier 40 may be used at all times without using the humidity detecting mechanism 18. Then, the humidity in the thermal recording apparatus 10 is minimized to cause an entire reduction of the moisture in the thermo-sensitive recording medium S, which enables a stable recording.

A description will now be made of a thermal recording apparatus 50 according to a second embodiment of the present invention, in which the same elements as in the first embodiment are designated by the same reference numerals and their detailed description will be omitted.

Figure 2:
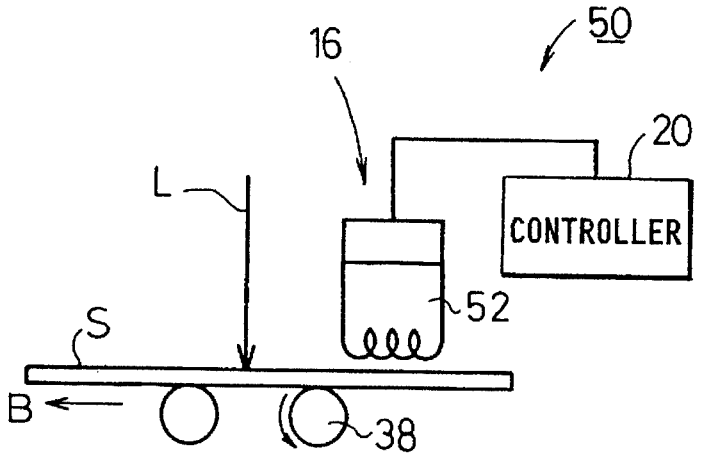
FIG. 2 is a schematic side view illustrating a thermal recording apparatus according to a second embodiment of the present invention.

As shown in FIG. 2, the thermal recording apparatus 50 has a heater 52 as the moisture content adjusting mechanism 16, which also serves as a heating means. The heater 52 is electrically connected to a controller 20. The thermal recording apparatus 50 may be equipped with a humidity detecting mechanism 18 similarly in the first embodiment as needed, though it is not equipped.

In the second embodiment, a thermal energy less than the coloring thermal energy of the thermo-sensitive recording medium S is applied by the heater 52 prior to irradiation of the thermo-sensitive recording medium S with a laser beam L. With the heat of the heater 52, the moisture contained in the thermo-sensitive recording medium S evaporates quickly. Thus, irradiating the thermo-sensitive recording medium S with the laser beam L after reducing the moisture content, the image or the like can be stably recorded.

Next, a thermal recording apparatus 60 according to a third embodiment of the present invention will be described below.

Figure 3:
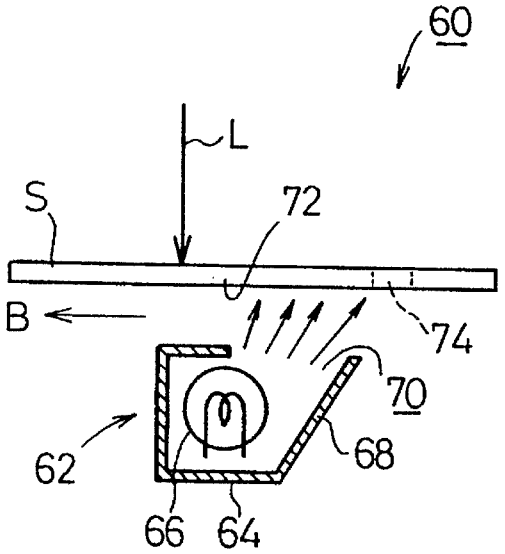
FIG. 3 is a schematic side view depicting a thermal recording apparatus according to a third embodiment of the present invention.

As illustrated in FIG. 3, the thermal recording apparatus 60 has a preheat mechanism 62, which is disposed under the thermo-sensitive recording medium S and in the vicinity of an irradiated spot of the recording medium S. The preheat mechanism 62 comprises a casing 64 and a light source 66. The casing 64 has a slanted side plate 68 which forms an opening 70 in the upper portion of the casing 64. The opening 70 directs the light ray from near the laser-irradiated region to the direction opposite to a sub-scanning direction (indicated by the arrow B) of the thermo-sensitive recording medium S.

Sending the thermo-sensitive recording medium S in the direction of the arrow B while the preheating light is being emitted from the light source 66, a portion having a certain length from 72 to 74 of the thermo-sensitive recording medium S is preheated and the moisture contained in that portion is effectively removed. After completion of the preheating, the amount of the moisture in the portion 72 to 74 of the thermo-sensitive recording medium S is adjusted to a level in which variations in the sensitivity is restricted in an allowable range. That is, the preheat mechanism 62, at the same time, serves as a moisture content adjusting mechanism, too.

A thermal recording apparatus 80 according to a fourth embodiment of the present invention will now be described below.

Figure 4:
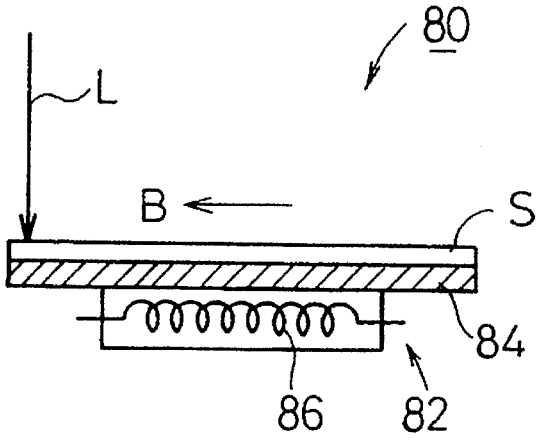
FIG. 4 is a schematic side view showing a thermal recording apparatus according to a fourth embodiment of the present invention.

As illustrated in FIG. 4, the thermal recording apparatus 80 has a preheat mechanism 82 which also serves as a moisture content adjusting mechanism. The preheat mechanism 82 comprises a preheat table 84 on which a thermo-sensitive recording medium S can be placed, and a heater 86.

In the fourth embodiment, the thermo-sensitive recording medium S is temporarily placed on the preheat table 84 of the preheat mechanism 82, for heating it by the heater 86 prior to preheating. In this condition, the moisture contained in the thermo-sensitive recording medium S is effectively removed and the sensitivity of the thermo-sensitive recording medium S is stabilized. The thermo-sensitive recording medium S is fed in the direction of the arrow B and preheated by the heater 86 to a temperature immediately below the color developing temperature of the medium S, and immediately after that, the thermo-sensitive recording medium S is irradiated with a laser beam L. Thus, a desired image or the like with is recorded on the thermo-sensitive recording medium S with high accuracy.

A description will next be made of a thermal recording apparatus 90 according to a fifth embodiment of the present invention.

Figure 5:
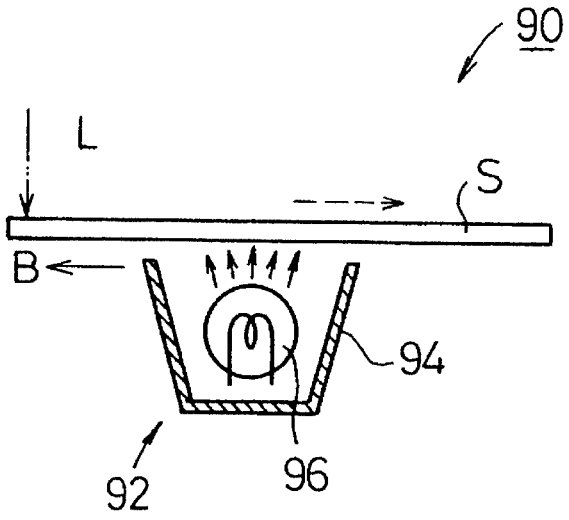
FIG. 5 is a schematic side view illustrating a thermal recording apparatus according to a fifth embodiment of the present invention.

As shown in FIG. 5, the thermal recording apparatus 90 has a preheat mechanism 92 which also serves as a moisture content adjusting mechanism. The preheat mechanism 92 comprises a casing 94 and a light source 96.

In the fifth embodiment, a thermo-sensitive recording medium S is fed in the direction indicated by the arrow B while being heated by the light source 96 of the preheat mechanism 92, and in this condition, the moisture contained in the medium S is effectively reduced prior to the irradiation thereof with a laser beam L.

Thereafter, the thermo-sensitive recording medium S is preheated while being fed in the direction opposite to the direction of the arrow B (see the broke line in the drawing) or while being conveyed again in the direction of the arrow B after returned to its original position.

Then, the thermo-sensitive recording medium S is irradiated with the laser beam L to record an image or the like thereon. Thus, at the time of the irradiation of the laser beam L, the moisture content of the thermo-sensitive recording medium S has been adjusted, so that a stable recording of an image or the like thereon made possible.

In the first to fifth embodiments described above, though the laser beam irradiating mechanism 12 which emits the laser beam L is used as a heating mechanism, a thermal head can be used as another heating mechanism. The thermal head can give thermal energy of a predetermined quantity to the thermo-sensitive recording medium S. Such a heating mechanism will next be described.

Figure 6:
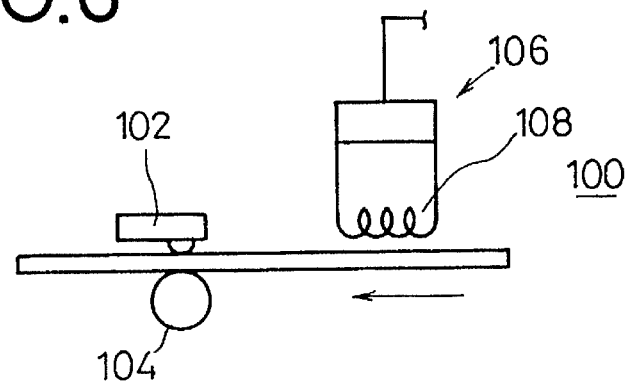
FIG. 6 is a schematic side view showing a thermal recording apparatus according to a sixth embodiment of the present invention.

In FIG. 6, there is shown a thermal recording apparatus 100 according to a sixth embodiment of the present invention. The thermal recording apparatus 100 comprises a thermal head 102 as a heating element, a platen-roller 104 and a heater 108. The heater 108 serves as a moisture content adjusting mechanism 106 which is the same as the moisture content adjusting mechanism 16 of the thermal recording apparatus 50 according to the second embodiment. The thermal head 102 has its length perpendicular to the direction in which the thermo-sensitive recording medium S is conveyed by the platen-roller 106 (as shown by an arrow), and applies thermal energy in a line to the thermo-sensitive recording medium S.

In the thermal recording apparatus 100, a thermal energy less than the coloring thermal energy of the thermo-sensitive recording medium S is applied by the heater 108 prior to application of the predetermined thermal energy by the thermal head 102. This results in vaporizing of the moisture contained in the thermo-sensitive recording medium S, and enables a stable recording of the image or the like on the thermo-sensitive recording medium S with the thermal head 102.

Figure 7:
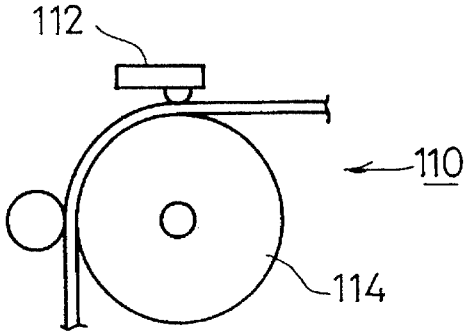
FIG. 7 is a schematic side view showing a thermal recording apparatus according to a seventh embodiment of the present invention.

In FIG. 7, there is shown a thermal recording apparatus 110 according to a seventh embodiment of the present invention. The thermal recording apparatus 110 comprises a thermal head 112 and a heat-roller 114 having a relatively large diameter. The heat-roller 114, providing therein a heater (not shown) and other things, having the same function as the preheat mechanism 62 has in the thermal recording apparatus 60 according to the third embodiment, or as the preheat mechanism 82, which serves also as the moisture content adjusting mechanism, has in the thermal recording apparatus 80 according to the fourth embodiment.

Thus, in the thermal recording apparatus 110, the thermo-sensitive recording medium S is heated while it is held in contact with the surface of the heat-roller 114 so that the moisture content of the thermo-sensitive recording medium S is adjusted, and that a stable recording of the image or the like with a high accuracy by the thermal head 112 is enabled.

Figure 8:
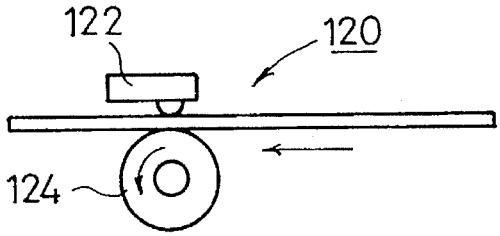
FIG. 8 is a schematic side view showing a thermal recording apparatus according to an eighth embodiment of the present invention.

In FIG. 8, there is shown a thermal recording apparatus 120 according to a eighth embodiment of the present invention.

The thermal recording apparatus 120 comprises a thermal head 122 and a platen-heat-roller 124 providing therein a heater (not shown) and other things. The operation of the thermal recording apparatus 120 is almost similar to that of the apparatus 100. Namely, the thermo-sensitive recording medium S is heated by the heater provided in the platen-heat-roller 124 while the thermo-sensitive recording medium S is being conveyed in the direction of the arrow by the rotation of the platen-heat-roller 124. Then, recording of the image or the like by the thermal head 122 on the thermo-sensitive recording medium S, in which the moisture content has been adjusted, is performed with high accuracy while the thermo-sensitive recording medium S is being conveyed in the opposite direction of the arrow, or again, in the direction of the arrow.

A thermal recording apparatus 130 according to a ninth embodiment of the present invention will now be described below.

Figure 9:
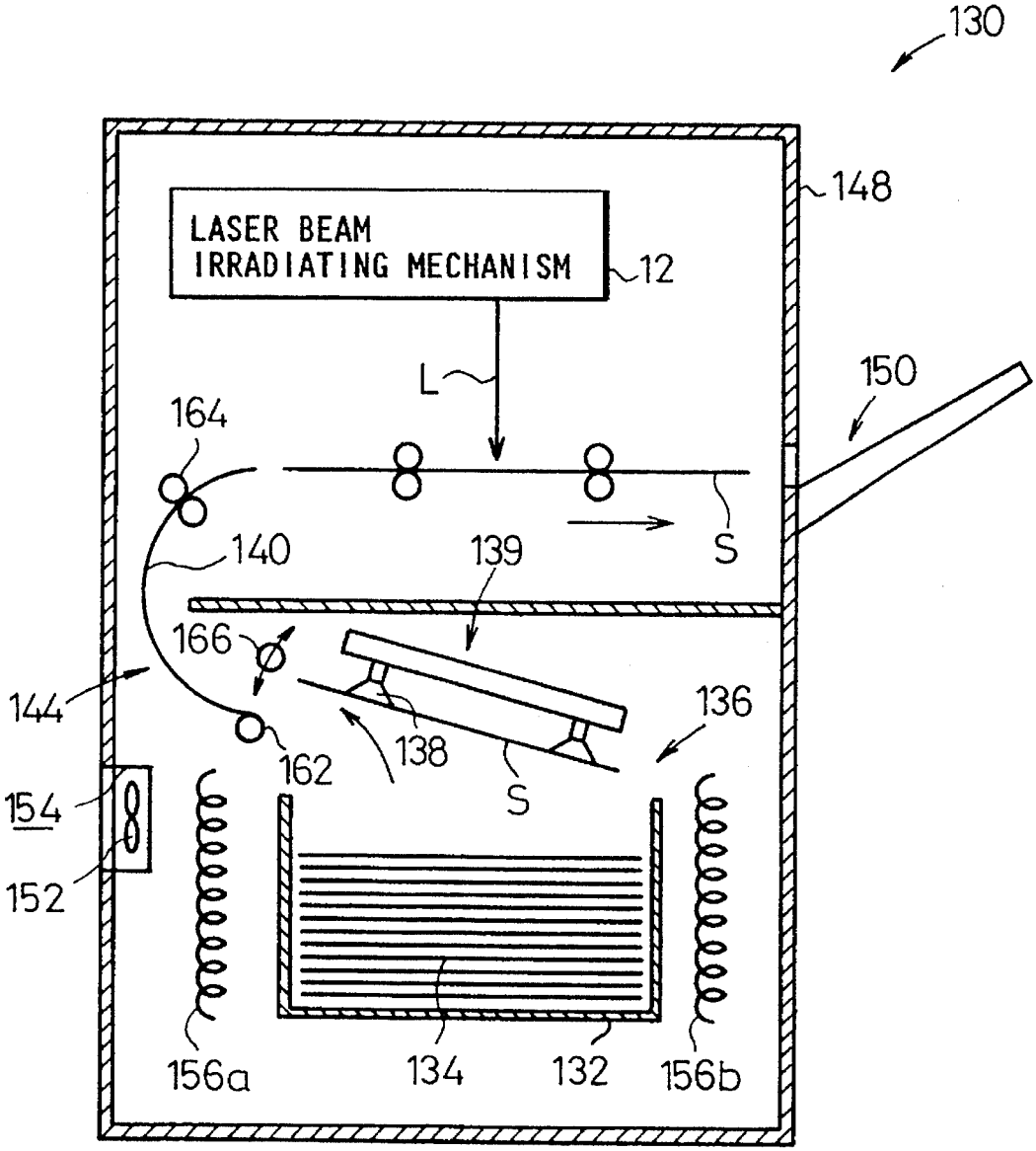
FIG. 9 is a schematic side view showing a thermal recording apparatus according to a ninth embodiment of the present invention.

As illustrated in FIG. 9, the thermal recording apparatus 130 comprises a holding unit 136 for accommodating thermo-sensitive recording mediums S in a casing 132 made of a material having a high thermal conductivity, such as a metal, a feeding device 139 for feeding thermo-sensitive recording mediums S stacked in the casing 132 one by one using suction pads 138, a conveying device 144 for conveying each of the thermo-sensitive recording mediums S to a position under a laser beam irradiating mechanism 12 via a guide member 140, and heating wires **156*a* and 156*b* which are located in close vicinity of the outer sides of the casing 132 and serve as preheating means. The heating wires 156*a* and 156*b* are controlled by a controller 20 and preheat stacked thermo-sensitive recording mediums S by applying a thermal energy less than the coloring thermal energy through the casing 132**.

A take-off device 150 for taking out a thermo-sensitive recording medium S with an image recorded thereon is mounted to one of both sides of a body 148 of the thermal recording apparatus 130. An air blower 154 having therein a fan 152 for keeping the temperature in the holding unit 136 constant, or cooling a thermo-sensitive recording medium S when the power to the heating wires **156*a* and 156*b* is made off, is mounted to the other side of the body 148. Further, the conveying device 144 includes a movable roller 166, a feed roller 162 and a pair of rollers 164. The movable roller 166 guides the uppermost thermo-sensitive recording medium S along the guide member 140 when the thermo-sensitive recording medium S is attracted and held by the suction pads 138 and moved in the direction of the arrow. The feed roller 162 and a pair of rollers 164 convey the thermo-sensitive recording medium S along the guide member 140**.

When the thermal recording apparatus 130 according to the ninth embodiment is turned on by the controller 20, the heating wires **156*a* and 156*b* provided on both sides of the holding unit 136 are energized to heat the thermo-sensitive recording mediums S stacked within the casing 132** to a condition immediately before coloring. Thus, the moisture content of each thermo-sensitive recording medium S can be effectively reduced, so that the sensitivity of each thermo-sensitive recording medium S is stabilized.

Air in the holding unit 136 is circulated by the fan 152 provided in the air blower 154 so that the entire surface of each thermo-sensitive recording medium S is uniformly heated. Further, since the heating of the thermo-sensitive recording mediums S by the heating wires **156*a* and 156*b* is carried out at all times so long as the thermo-sensitive recording mediums S are held in the casing 132**, the thermo-sensitive recording mediums S can be stably heated. Since each of the thermo-sensitive recording mediums S is preheated to a temperature immediately below the color developing temperature, it is not necessary to employ a high-output laser diode in recording an image on the uppermost thermo-sensitive recording medium S by a laser beam L. Further, since each of the thermo-sensitive recording mediums S is always kept at the condition immediately before coloring, a waiting time for the image recording can be shortened.

Figure 10:
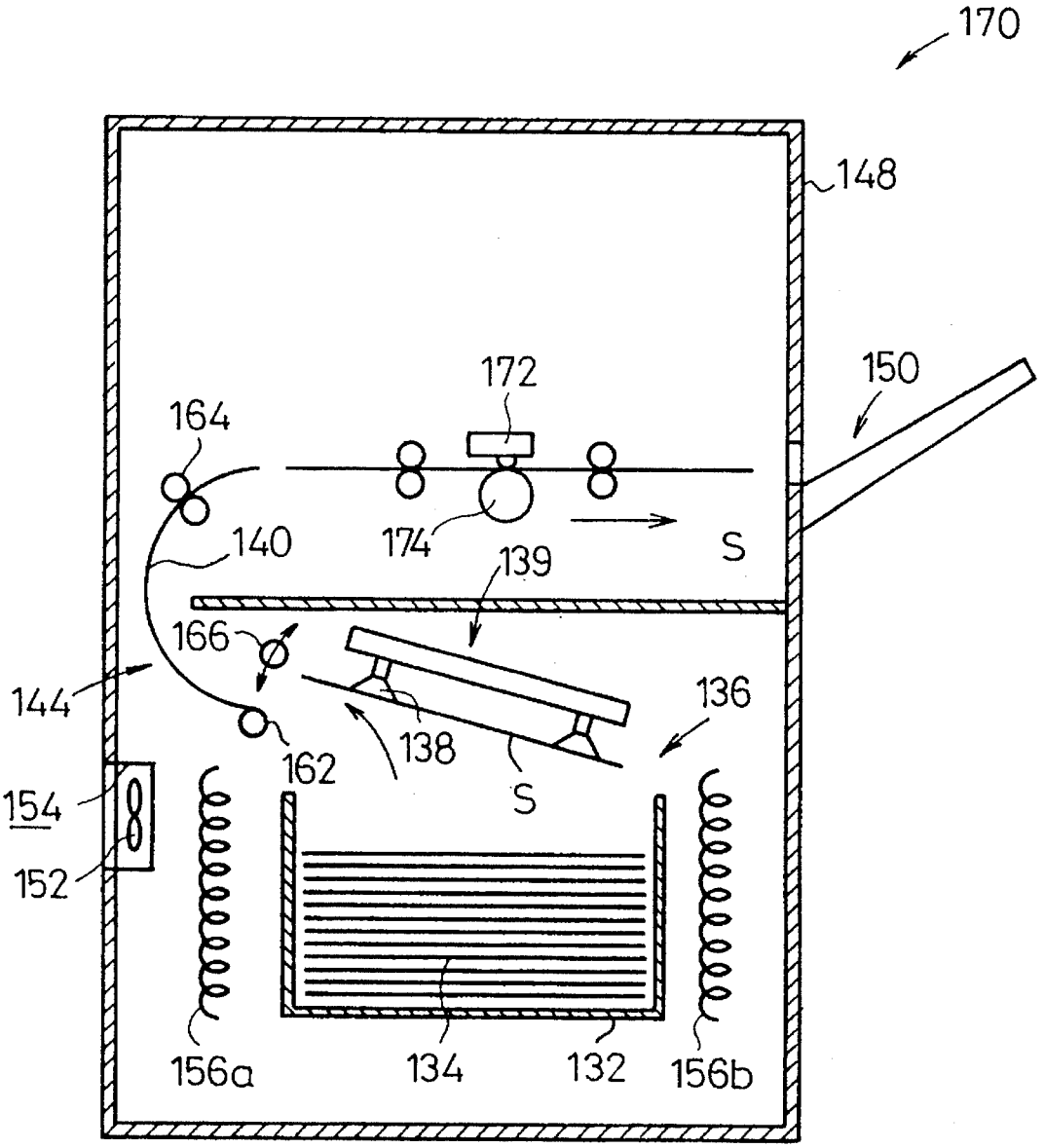
FIG. 10 is a schematic side view showing a thermal recording apparatus according to a tenth embodiment of the present invention.

In FIG. 10, there is shown a thermal recording apparatus 170 according to a tenth embodiment of the present invention.

The thermal recording apparatus 170 comprises all the elements employed in the ninth embodiment, together with a thermal head 172 instead of the laser irradiating mechanism 12, and a platen-roller 174. The operations of the thermal head 172 and the platen-roller 174 are the same as those of the similar elements employed in the sixth embodiment, and the operations of the rest of the elements are the same as those in the ninth embodiment. Therefore, a detailed description of the operations in the present embodiment is omitted.

Having now fully described the invention, it will be apparent to those skilled in the art that many changes and modification can be made without departing from the spirit or scope of the invention as set forth herein.

What is claimed is:

1. A method of thermally recording an image on a thermo-sensitive recording medium by applying a coloring thermal energy thereto, comprising the steps of:

adjusting the amount of moisture contained in said thermo-sensitive recording medium; and applying said coloring thermal energy for thermally recording said image to said thermo-sensitive recording medium whose moisture content has been adjusted.

2. A method according to claim 1, further comprising a step of for preheating said thermo-sensitive recording medium by applying a thermal energy less than said coloring thermal energy prior to the application of said coloring thermal energy.

3. A method according to claim 1 or 2, wherein said step of applying the coloring thermal energy to said thermo-sensitive recording medium is effected by irradiating said thermo-sensitive recording medium with a laser beam.

4. A method according to claim 1, wherein said step of applying the coloring thermal energy to said thermo-sensitive recording medium is effected by using a thermal head.

5. An apparatus for thermally recording an image on a thermo-sensitive recording medium by applying a coloring thermal energy thereto, comprising:

a heating mechanism for applying the coloring thermal energy for thermally recording said image on said thermo-sensitive recording medium in a line;

a conveying mechanism for conveying said thermo-sensitive recording medium in a direction perpendicular to said line; and a moisture content adjusting mechanism for adjusting the amount of moisture contained in the thermo-sensitive recording medium prior to the application of said coloring thermal energy.

6. An apparatus according to claim 5, wherein said heating mechanism comprises a laser beam irradiating mechanism for irradiating said thermo-sensitive recording medium with a laser beam.

7. An apparatus according to claim 5, wherein said heating mechanism comprises a thermal head.

8. An apparatus according to claim 5, further comprising a humidity detecting mechanism for detecting the humidity in the environment near said thermo-sensitive recording medium.

9. An apparatus according to claim 5, wherein said moisture content adjusting mechanism serves, also as a preheating mechanism which applies a thermal energy less than said coloring thermal energy to said thermo-sensitive recording medium prior to the application of said coloring thermal energy.

10. A method according to claim 2, wherein said step of applying the coloring thermal entry to said thermo-sensitive recording medium is effected by irradiating said thermo-sensitive recording medium with a laser beam.

11. A method according to claim 2, wherein said step of applying the coloring thermal energy to said thermo-sensitive recording medium is effected by using a thermal head.

12. The method according to claim 1, further comprising the step of:

sensing the humidity in the atmosphere in a vicinity of a location at which the color thermal energy is applied to the thermo-sensitive recording medium, and wherein the evaporating step is controlled in accordance with the humidity in the atmosphere.

13. The method according to claim 1, wherein the step of adjusting the amount of moisture includes the step of evaporating moisture contained in said thermo-sensitive recording medium by applying a thermal energy less than said coloring thermal energy.

14. The method according to claim 13, wherein the step of evaporating includes conveying said thermo-sensitive recording medium past a heater.

15. The method according to claim 13, wherein the step of evaporating includes conveying said thermo-sensitive recording medium over a heated table.

16. The method according to claim 13, wherein the step of evaporating includes conveying said thermo-sensitive recording medium over a heat roller.

17. The method according to claim 13, wherein the step of evaporating includes storing said thermo-sensitive recording medium in a heated casing.

18. The method according to claim 1, wherein the step of adjusting the amount of moisture includes the step of dehumidifying the atmosphere within a thermal recording apparatus in which the thermo-sensitive recording medium is located, such that the amount of moisture contained in said thermo-sensitive recording medium is controlled.

19. The method according to claim 18, further comprising the step of:

sensing the humidity in the atmosphere in a vicinity of a location at which the color thermal energy is applied to the thermo-sensitive recording medium, and wherein the dehumidifying of the atmosphere is controlled in accordance with the humidity in the atmosphere.

20. The apparatus according to claim 5, wherein the moisture content adjusting mechanism includes evaporating means for evaporating moisture contained in the thermo-sensitive recording medium by applying to said thermo-sensitive recording medium a thermal energy less than said coloring thermal energy.

21. The apparatus according to claim 20, wherein the evaporating means comprises a heater, the thermo-sensitive recording medium being conveyed past the heater.

22. The apparatus according to claim 20, wherein the evaporating means comprises a heated table, said thermo-sensitive recording medium being conveyed over the heated table.

23. The apparatus according to claim 20, wherein the evaporating means comprises a heat roller, said thermo-sensitive recording medium being conveyed over the heat roller.

24. The apparatus according to claim 20, wherein the evaporating means comprises a heated casing, said thermo-sensitive recording medium being stored in the heated casing.

25. The apparatus according to claim 5, further comprising: a humidity detecting mechanism for detecting the humidity in the atmosphere in a vicinity of a location at which the color thermal energy is applied to the thermo-sensitive recording medium, and wherein the dehumidifier is controlled in accordance with the detected humidity.

26. The apparatus according to claim 5, wherein the moisture content adjusting mechanism includes a dehumidifier for dehumidifying the atmosphere within said apparatus, such that the amount of moisture contained in said thermo-sensitive recording medium is controlled.

27. The apparatus according to claim 26, further comprising:

a humidity detecting mechanism for detecting the humidity in the atmosphere in a vicinity of a location at which the color thermal energy is applied to the thermo-sensitive recording medium, and wherein the dehumidifier is controlled in accordance with the detected humidity.

* * * * *